United States Patent [19]

Wisdom

[11] Patent Number: 4,619,650

[45] Date of Patent: Oct. 28, 1986

[54] PLASMA BAGS

[75] Inventor: Leonard A. Wisdom, West Pymble, Australia

[73] Assignee: Miles Laboratories, Inc., Elkhart, Ind.

[21] Appl. No.: 721,637

[22] Filed: Apr. 9, 1985

[30] Foreign Application Priority Data

Jul. 13, 1984 [GB] United Kingdom ..... 8417914

[51] Int. Cl.[4] ..... A61J 1/00

[52] U.S. Cl. ..... 604/408; 206/628

[58] Field of Search ..... 604/408, 410; 383/121, 383/127, 906; 206/620, 628

[56] References Cited

U.S. PATENT DOCUMENTS

| | | | |
|---|---|---|---|
| 3,692,493 | 9/1972 | Terasaki | 604/410 |
| 4,174,040 | 11/1979 | Wang | 206/620 |
| 4,278,198 | 7/1981 | Norton et al. | 604/408 |

FOREIGN PATENT DOCUMENTS

| | | |
|---|---|---|
| 0076062 | 6/1983 | European Pat. Off. . |
| 1147846 | 4/1969 | United Kingdom . |
| 1518392 | 7/1978 | United Kingdom . |

*Primary Examiner*—Dalton L. Truluck
*Assistant Examiner*—Michelle N. Lester
*Attorney, Agent, or Firm*—James A. Giblin

[57] ABSTRACT

A plasma transfer bag for containing plasma, the bag having a line of weakness extending from the top to the bottom of the bag, the bag being made from two sheets of translucent flexible material which is flexible at −40° C., the sheets being welded together around the edges and across the bottom to provide plasma containment means, the sheets extending from the bottom weld to form an extension having a break therein, the bag may be held and pulled transversely to enable the bag to be torn from the break to the top of the bag along the line of weakness.

10 Claims, 8 Drawing Figures

PLASMA BAGS

RELATED APPLICATION

Patent application Ser. No. 06/485,564 filed Apr. 15, 1983 and entitled, Plasma Bags.

The present invention relates to plasma bags, and in particular to plasma bags which can be removed from frozen plasma without contamination.

All blood products should be demonstrably non-pyrongenic and effort is necessary to monitor and control the microbial levels (particularly of gram-negative organisms) at each stage of the fractionation process. To this end, the microbial levels are monitored throughout processing.

In Scotland, plasma is supplied frozen in PVC or polyethylene packs of various size and due to the care taken at regional blood transfusion centres the plasma content is of a high standard with colony counts on representative samples revealing a mean contamination level of 0.6 organisms per ml. Once thawed for processing the mean contamination level of the cooled plasma rises to 273 organisms per ml and it is clear that the microbial input is attributable to the procedure for plasma removal and thawing. The plasma pack is slit open and frozen plasma is removed and fed into a mill for comminution prior to thawing. This process involves considerable handling of the frozen plasma. Microbiological assessment has revealed that, despite regular rinsing in 70% alcohol, the gloved hands of the operator become significantly contaminated and this results in microbial transfer to the surface of the handled materials. Investigation has revealed that the principal source of glove contamination is the outer surface of the plasma pack. It has also been shown that the level of contamination rises as the work process continues, lending support to the belief that the main contaminating vector is the glove of the operator. Contact samples taken from the surface of 335 packs have revealed mean contamination levels of 13.5 organisms per contact plate (25 sq cm in area), with some 3% of plates showing confluent growth.

As the handling of these packs results in significant microbial input a solution to this problem is desirable. There are two possibilities, the outer pack surface could be decontaminated or operating handling could be eliminated.

In the light of the above evidence and steadily increasing plasma processing requirement for all types of plasma, there is a need for a pack stripping system which is compatible with the maintenance of therapeutic protein levels (in particular factor VIII) and current standards of good pharmaceutical manufacturing practice. Such standards when applied to the process of removing clean frozen plasma from its microbiologically contaminated container can be translated into design criteria which are summarised as:

(I) The prevention of contact, at any time, between frozen plasma pellet and the outer surface of the pack.

(II) The capability of eliminating manual presentation of frozen packs to the stripping device.

(III) The exclusion of any feature which may carry contamination from the outside surface of one pack to subsequent packs entering the process.

(IV) Fabrication from materials and to a design which facilitates regular cleaning and sanitisation.

(V) A minimum of moving parts which may cause adventitious particulate contamination of the "naked" plasma.

(VI) Compatibility with operation in a controlled environment (e.g. BS 5295 Class II or III) or an ability to provide localised protection of the "naked" plasma prior to crushing and subsequent fractionation.

(VII) A pack and stripping system which will ensure a total separation of plasma and plastic.

In the Lancet, Apr. 7th, 1982, Watt et al outline requirements for overcoming these problems. Our patent application No. GB8400854 attempts to fulfil those requirements by providing a plasma transfer bag for containing plasma, the bag being made from translucent flexible sterilizable material, the bag being closed at the bottom and having an extension in which there are means for gripping or holding the bag, the extension flap additionally having a break which may allow the bag to be split from the break up to the top of the bag when the extension is gripped either side of the notch.

This is a simple concept which has been developed so that the break in the extension flap leads naturally into the bag. Lateral pull towards the corners of the extension flap in the lower part of the bag causes it to split open such that any frozen plasma contained within the bag can be removed without contact with the contaminated outer surface of the bag. Handling in this manner removes the need to spray, wash or otherwise sanitise the pack's surface.

The bag as described in our copending application No. GB8400854 fulfils the requirements. However, one of the problems that does occur with the bag is lack of uniform tearing of the bag on lateral tearing at the corners. When used in conjunction with a bag opening machine, the lack of uniformity in tearing can cause the frozen plasma to eject from the bag in an uncontrollable manner. The present invention attempts to overcome this problem.

According to the present invention, there is provided a plasma transfer bag of flexible sterilizable material, the bag having two side walls and being closed at the base, the bag having an extension to the base for gripping or holding the bag, the extension having a break therein extending to the base of the bag, the bag having a line of weakness in the walls extending from the break to the top of the bag, the bag on each side of the line of weakness being reinforced at least adjacent the base to control tearing of the bag from the base to the top of the bag when opposing forces are applied to the extension in a transverse direction parallel to the base of the bag to cause the bag to split and eject the contents.

The present invention also provides a plasma transfer bag for containing plasma, the bag having a line of weakness extending from the top to the base of the bag, the bag on each side of the line of weakness having reinforcement thereto at least adjacent the base of the bag, the bag being made from two sheets of flexible material which is flexible at −40° C., the sheets being welded together around the edges and across the bottom to provide plasma containment means, the sheets extending from the bottom weld to form an extension having a break therein, by which extension the bag may be held and pulled transversely to enable the bag to be torn from the break to the top of the bag along the line of weakness.

The bag may be made of flexible sheet material such as polyethylene or polyvinylchloride or any known suitable material used in this particular art. The type of material used is not critical although it must be flexible over a whole range of temperatures under which the plasma transfer bag is used. The flexibility of the pack may be determined by increased amount of plasticiser during the manufacture of the flexible sheet material. It is also important that the flexible sheet material is not prone to cold fracture at −40° C., the temperature of storage. This is particularly important with regard to the extension flap and as the material must be flexible such that the flap does not break off when it is gripped in order to split the bag.

The flexible sheet materials are welded together in a known manner around the periphery to form a bag of, for example, approximately rectangular shape or triangular shape. The welding may be by high frequency current. At one end, transfer tubing in the form of one or more tubes is inserted to allow plasma into the bag following collection. At the base of the bag, an extension flap is formed by a further weld inset into and across the width of the bag. Holes may be provided at each corner for suspension purposes and optionally so that gripping means may pass through the holes such that the extension flap either side of the break can be pulled apart and a tear extend from the break through the bag to the inlet tube or tubes.

The gripping means may clamp the extension flap either side of the break. The flap is pulled transversely either side of and away from the break. As a result of such pulling, the break extends from the extension flap through the bag to the inlet tube or tubes.

As indicated the bag has a line of weakness preferably in each wall, which extends from the base of the bag to the top to facilitate tearing of the bag when the extension is pulled transversely. The line of weakness is generally sufficient to determine that the bag should split along the line. However, in order to direct the transverse force into a bag splitting force the bag is reinforced on either side of the line of weakness. This reinforcement is generally by means of a weld either side of the line and preferably in each wall of the bag. It is preferred that the weld on each side of the line extends no more than is sufficient to direct the tearing force along the line of weakness and this is preferably less than 10% of the length of the line of weakness from the base of the bag and preferably no more than 6%. It has been found that the reinforcement adjacent the base of the bag only is sufficient. The reinforcement may extend laterally or perpendicularly away from the line of weakness.

The bag shape is optional. As already stated it may have a generally rectangular shape. Alternative shapes are possible such as triangular shape, or rounded shape. It is preferred that the inlet tubes enter at one end and in general form a locating means for the bag when it is placed in a stripping machine, such as that described in patent application No. 8406956.

The present invention will be further described, by way of example only, with reference to the accompanying drawings, in which:

FIG. 1 is a plan view of one form of a bag of the present invention;

FIGS. 1*a*, 1*b* and 1*c* are cross-sections along the lines A—A; B—B and C—C, respectively;

Figure 1:
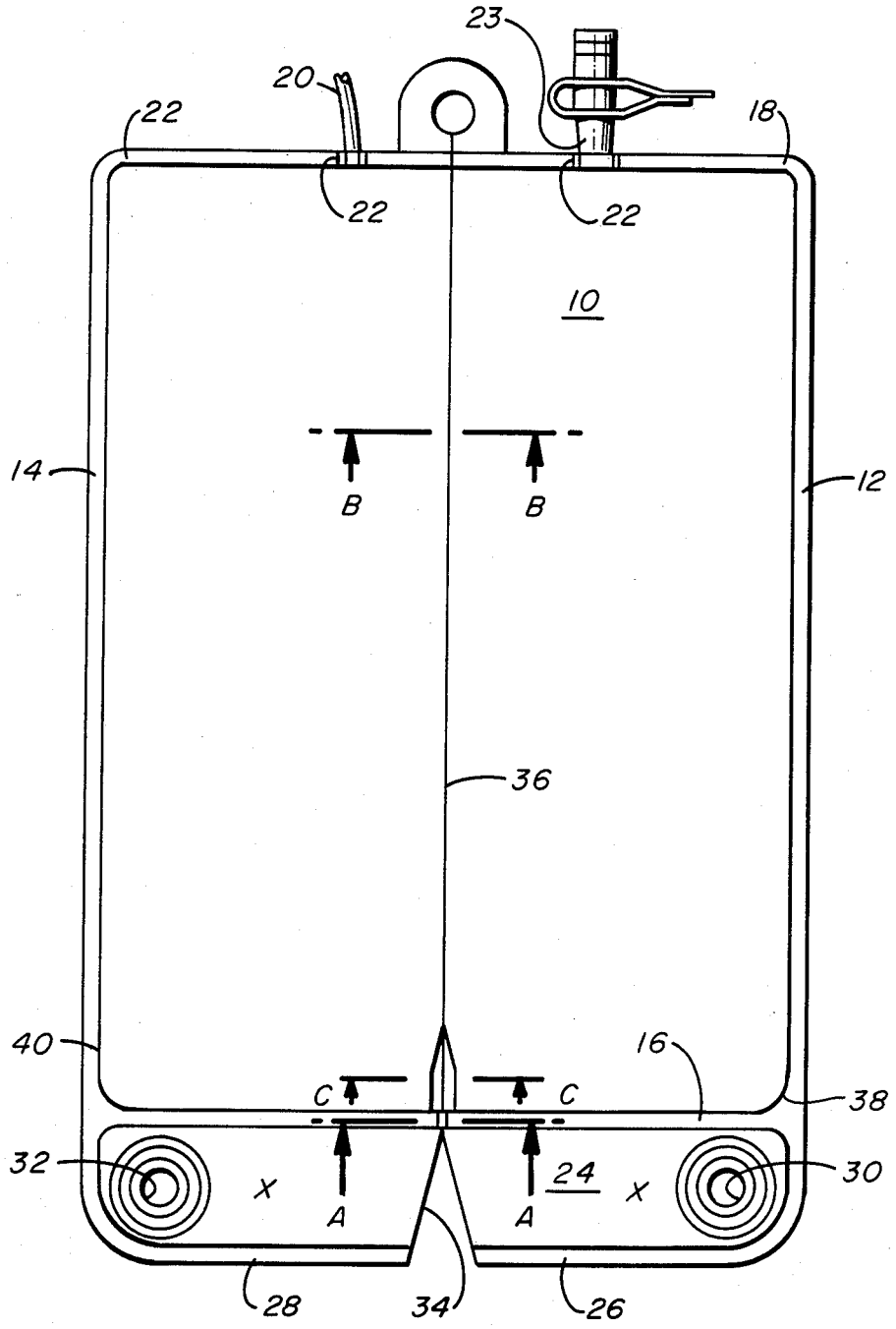
Figure 1A:
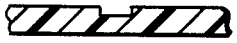
Figure 1B:
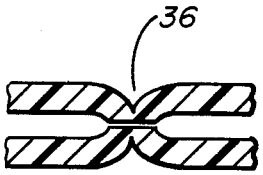
Figure 1C:
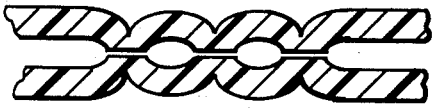

A bag generally designated 10 is made up of two flexible sheets which are welded together along their sides 12,14 and a bottom 16 and top 18 to form a generally rectangular shape. An inlet tube 20 of plastics material passes through a weld 22 into the bag. A further closing off tube 23 also passes through the weld 22. At the bottom 16 or base of the bag 10, an extension flap 24 is formed by means of welds along its periphery 26,28 and extensions of the side welds 12,14. In the corners of the extension flap are positioned two holes 30, 32 to enable the bag to be suspended should the plasma be required for clinical infusion. In the middle of the extension flap is positioned break in the form of a notch 34, extending from the welds 26,28. In FIG. 1 a V-shaped notch 34 is shown, although other shapes may be used, as will be further described. A line of weakness 36 in each sheet material forming each side of the bag extends from the bottom weld 16 to the part of the bag adjacent the inlet tube 20. The line of weakness is generally a score line of about 25 μm depth in a wall thickness of 0.5 mm. It is preferably made on both bag walls. An alternative form of a line of weakness is produced by high frequency current in the surface of one or both of the bag walls.

It is preferred that the bottom corners of the bag 38,40 should be rounded on the inner aspect of the weld. Rounded corners 38,40 allow the frozen tablet of plasma contained within the bag after collection, to be ejected more easily. It also prevents the fouling of the bag on the frozen plasma tablet.

Figure 2:
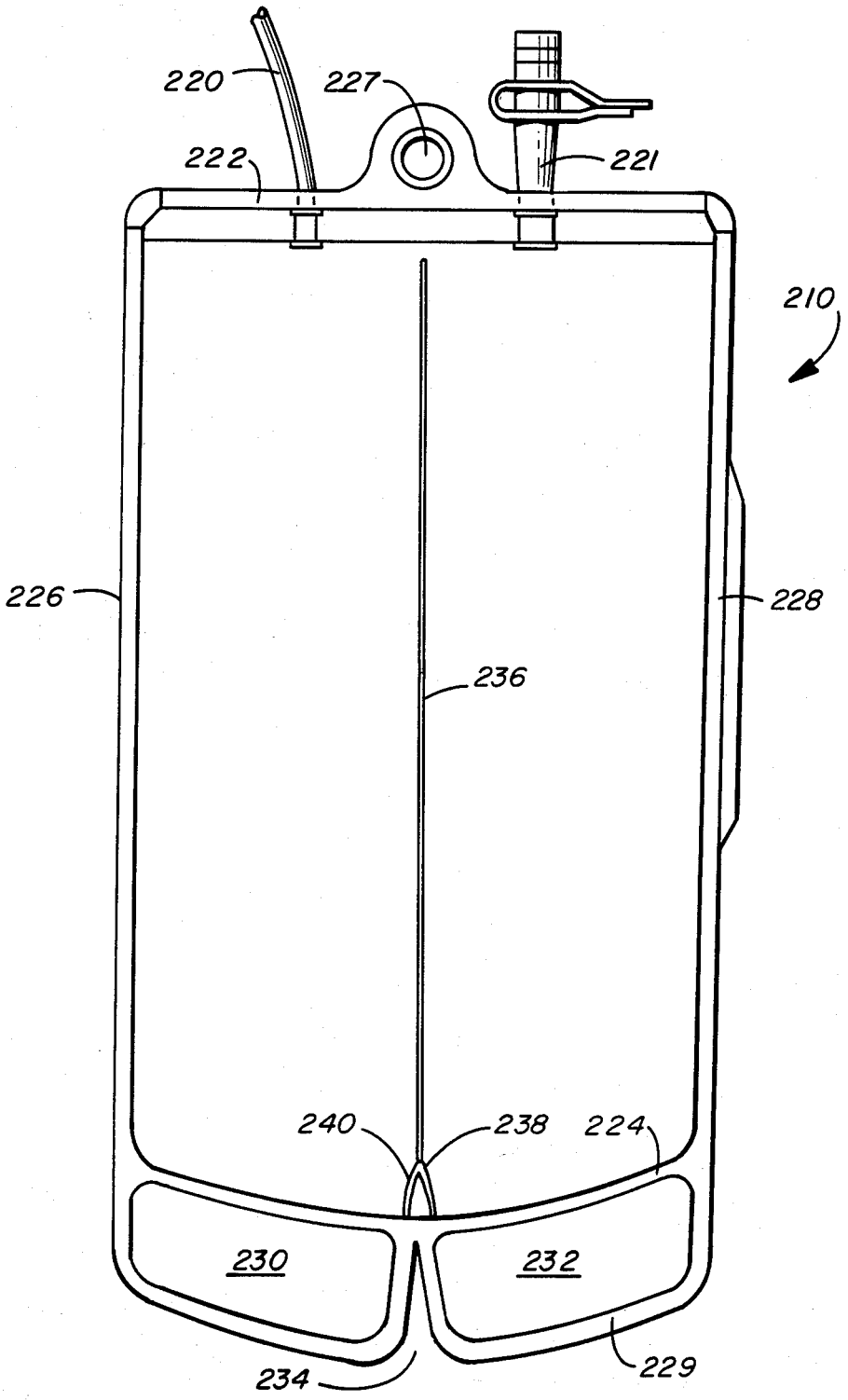
FIG. 2 is a plan view of an alternative bag.

Referring to FIG. 2, a bag having two inlet tubes 220,221 is shown. One of the inlet tubes 220, is used for filling the bag, whereas the second is to be used as an entry point if the plasma is used as a clinical preparation. The base weld of the bag 224 is generally rounded.

The bag 210 is manufacturered by placing a rectangular sheet of flexible translucent material on top of a further sheet of flexible translucent material. An inlet tube 220 is interposed between the sheets of material along a short side 222 thereof. A further tube 221 is interposed between the two sheets. The bag is welded across the top 222 sealing the tubes 220 and 221 into position and forming a suspension point 226. Side welds 226,228 are made along the length of the bag. A base weld 224 is formed which is curved, to seal the bag. A further extension weld 229 is made which divides the extension portion into two 230,232 to form a break 234. A line of weakness 236 extends from the break 234 to the top weld 222 over the bag 210. Either side of the line of weakness 236 at the base 224 of the bag is further reinforcement 238,240 which may be a reinforcing weld. The reinforcing welds 238,240 preferably are adjacent the base 224 of the bag and extends either side of the line of weakness 236 at least partially along the length of the line of weakness 236 and at least partially along the base of the bag. This length may be up to 10% of the total length but is generally about 6% of the length of the line of weakness 236. The reinforcement welds are preferably on both bag walls and may extend along the base of the bag as required. The purpose of the reinforcement either side of the line of weakness 236 is to direct the tearing force along the line of weakness. A possible disadvantage of our plasma bag described in our earlier patent application No. 8400854 is that some of the tearing forces if not applied evenly to the line of weakness 236 cause the wall of the bag to split along an undetermined line causing ejection of the plasma at an angle that is required. Incorporation of the reinforcement either side of the line of weakness particularly at the initial point at the base of the bag causes tearing forces to be applied to the line of weakness and to be directed along it to the top of the bag. In this manner, tearing forces are applied evenly to the bag causing it to split symmetrically and to eject the plasma in the direction required.

Figure 4:
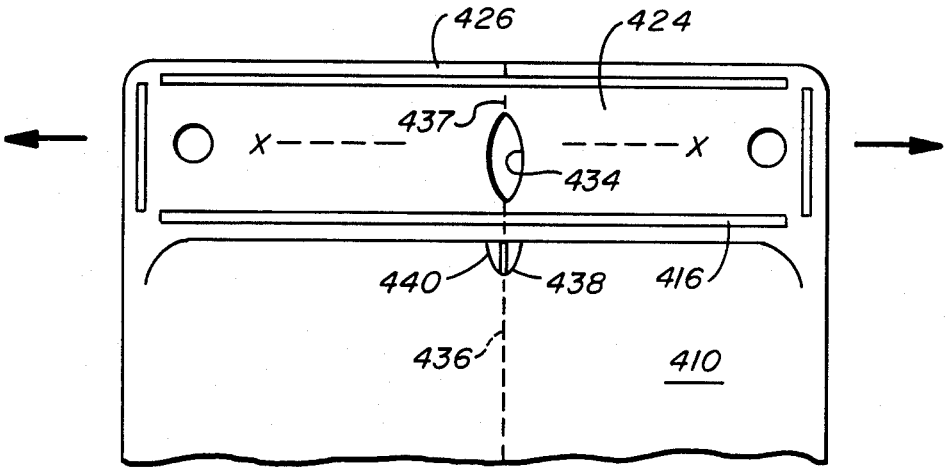
FIG. 4 shows a plan view of one embodiment of the bag.

Referring to FIG. 4, an alternative form of extension is shown in which the break is in the form of an elliptical hole 434 in the centre of the extension flap 424. The elliptical hole 434 does not break the bottom weld 426. During the filling of the type of bag as shown in FIG. 1 and subsequent freezing, the base of the bag contracts causing a tendency for the notch 434 to open wider causing the extension 424 to form a "fishtail-like" extension at the bottom of the bag. As shown in FIG. 4 the elliptical hole 434 which does not extend through he weld 426 prevents the "fishtailing" of the bag extension 424. Nevertheless, the elliptical hole 434 which forms the break in the extension flap on transverse pulling will cause tearing of the bag. To facilitate this a weakened tear-line is provided in the bag which is preferably 24 μm in a bag thickness of 0.5 mm. Either side of the weakened tear-line 436 for at least part of its length, is a reinforcement 438,440 preferably in the form of a weld is provided. The weld preferably extends only a distance sufficient to direct any tearing forces along the length of the line of weakness.

The line of weakness in any of the embodiments may be applied by scoring or by high frequency current in a similar manner to the welding.

Figure 5:
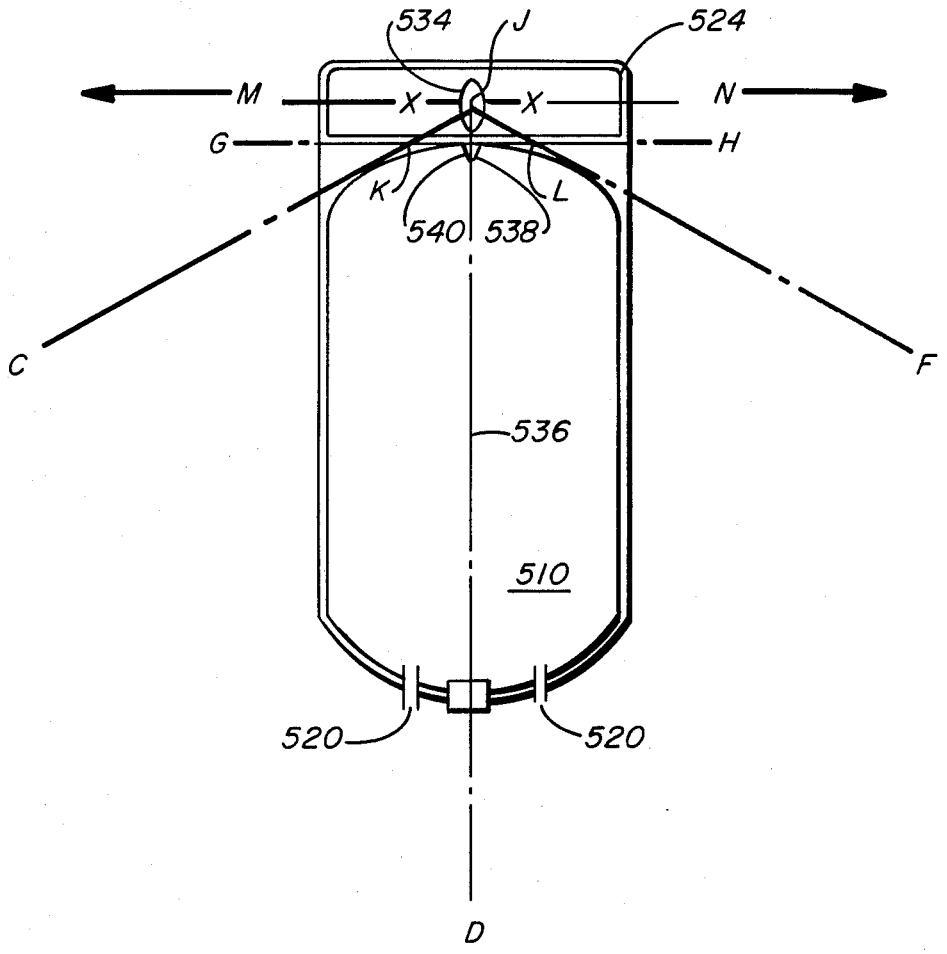
FIG. 5 shows a plan view of a further embodiment of the present invention.

Another embodiment is shown in FIG. 5. A plasma transfer bag 510 has inlet tubes 520 sealed to the bag. The extension flap 524 is divided from the main portion of the bag 510 along the line GH. An elliptical hole 534 is provided in the extension to form the break in the extension flap when a transverse pull is applied in the direction of the arrows. This causes the bag to split along the line JD along a weakened tear line 536 (as previously described in relation to other embodiments) provided in the bag. Reinforcing welds 538,540 are provided either side of the weakened tear line. To prevent the ice mass from fouling the bag 510 as it is withdrawn, the part of the bag adjacent the extension flap 524 is rounded such that the curve is a tangent of lines CJ and FJ which intersect the division line GH between the bag and the extension at points K and L respectively. It is preferred that the angles GKC and HLF be less than 45° and probably in the region of 20° to 30°. Although the curved base has been described in relation to FIG. 5, the bags shown in FIGS. 2 and 3 may also have the same dimensions.

The point J in FIG. 5 should preferably fall in the middle of the elliptical hole 534. The two gripping points on the extension flap 524 marked X should preferably be towards the middle line MN of the extension flap 524. The middle line MN should not be as close to the line GH as the point J. This prevents the bag from shearing along the lines CJ and FJ rather than along the weakened line DJ.

Figure 3:
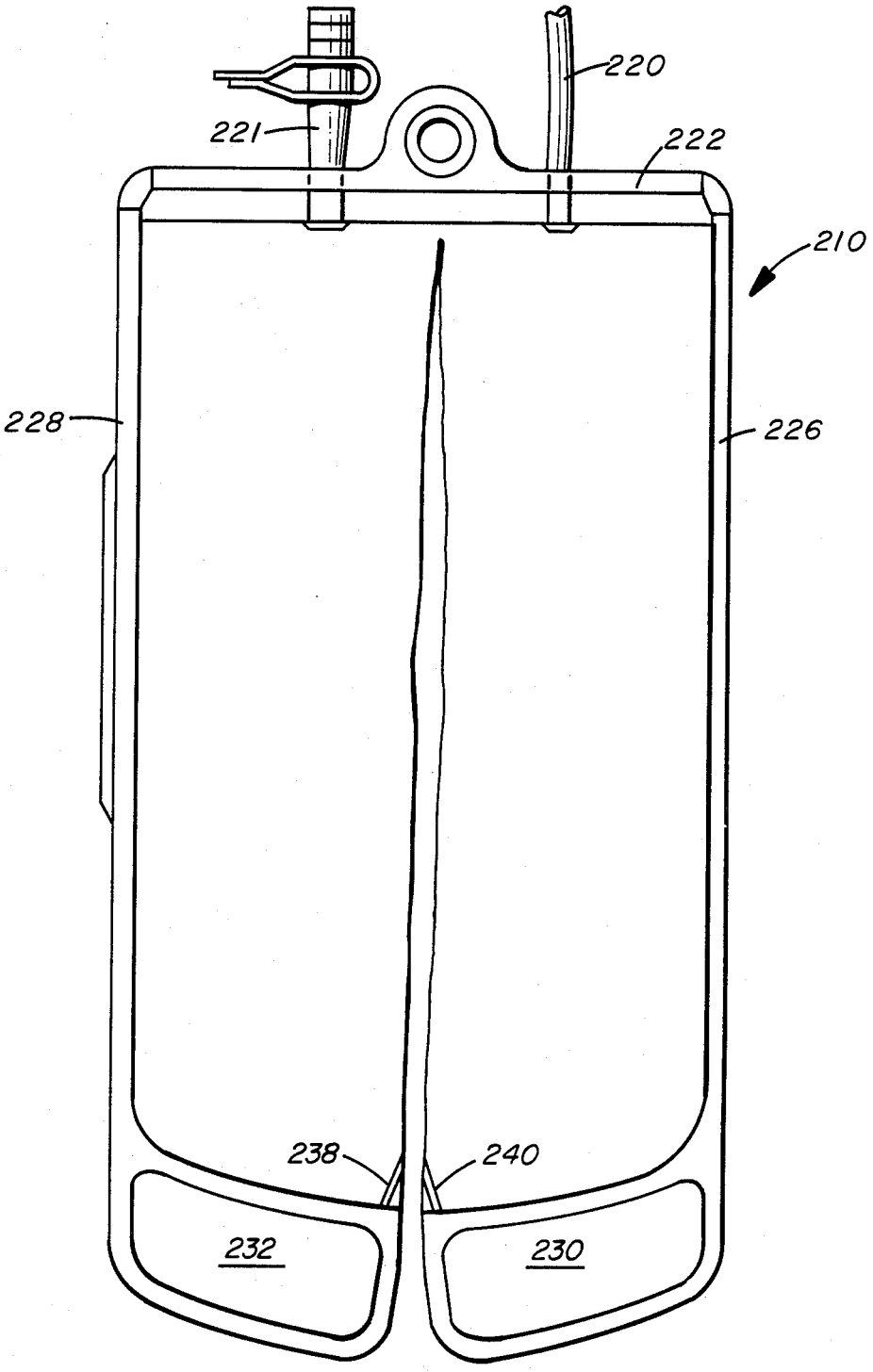
FIG. 3 is a plan view of the bag of FIG. 2 after tearing has taken place.

In use, the bag 10 of FIG. 1 which is a flat bag is filled with plasma via the inlet tube 20 which is subsequently sealed. The bag 10 is then frozen. To remove the frozen plasma tablet from the bag 10, the extension flap 24 is gripped at the two points marked "X" and lateral pull is applied in the directions of the two arrows either side of the notch 34. The line of weakness at 36 extending from the notch 34 up the bag on the lateral pull causes the bag 10 to split open, as shown in FIG. 3, and the frozen plasma tablet is ejected. The reinforcing means either side of the line of weakness causes the tearing forces to be directed along the line of weakness. Similar use considerations apply with the form of extension flap 424 shown in FIG. 4. In this case the line of weakness 436 extends from the elliptical hole 434 to the inlet tubing but also from the elliptical hole 434 to the bottom weld 426 via weakened line 437. Clamping the bag at the points "X" and providing lateral pull in the direction of arrows causes the line of weakness to break the bag and split it up to the inlet tube along weakened lines 436,437. The frozen tablet of plasma is ejected without touching the outer surface of the bag 410.

The bags as described are intended to be used in conjunction with a bag stripping machine described in U.K. Patent Application No. 8223225. The bag stripping machine is designed to accept packs between 130 and 160 mm in width and from 200 to 240 mm long. This range has been chosen to allow the pack design for varying volumes of plasma to form frozen tablets of 20 to 30 mm thick. The plasma is generally frozen in a mould to form a slab of uniform shape.

Accordingly, the extension flap is preferably not less than 25 mm deep, i.e. the length being the distance between the lower weld 26 of the extension flap and the lower weld 16 of the bag as shown in FIG. 1 or the corresponding welds 426 and 416 of FIG. 4. In the corners of the bag, the holes made for suspending the bag to use the plasma in clinical infusion, are generally in the size range of 7 to 10 mm diameter. It is recommended that these holes should be not less than 40 mm from the break in the extension flap and that the point of gripping the bag should be about 37 mm or greater. The preferred gripping position is in the centre of the extension flap.

I claim:

1. A plasma transfer bag of flexible sterilizable material, the bag having two side walls and being closed at the base, the bag having an extension to the base for gripping or holding the bag, the extension flap having a break therein extending to the base of the bag, the bag having a line of weakness in the walls extending from the break to the top of the bag, the bag on each side of the line of weakness being reinforced by means of a weld adjacent the base and extending no more than about 10% of the length of the line of weakness from the base of the bag, the weld adapted to control tearing of the bag from the base to the top of the bag when opposing forces are applied to the extension in a transverse direction parallel to the base of the bag to cause the bag to split and eject the contents.

2. A plasma transfer bag as claimed in claim 1 which is made of material flexible at −40° C.

3. A plasma transfer bag as claimed in claim 1 or claim 2 in which the material is selected from polyethylene and polyvinylchloride.

4. A plasma transfer bag as claimed in any one of the preceding claims wherein the break is a V-shaped notch.

5. A plasma transfer bag as claimed in any one of claims 1 to 3 wherein the break is an elliptical hole in the extension between the closed bottom of the bag and the bottom of the extension flap.

6. A plasma transfer bag for containing plasma, the bag having a line of weakness extending from the top to the base of the bag, the bag on each side of the line of weakness having a reinforcing weld adjacent the base of the bag and extending no more than about 10% of the length of the line of weakness from the base of the bag, the bag being made from two sheets of flexible material which is flexible at −40° C., the sheets being welded together around the edges and across the bottom to provide plasma containment means, the sheets extending from the bottom weld to form an extension flap having a break therein, by which extension the bag may be held and pulled transversely to enable the bag to be torn from the break to the top of the bag along the line of weakness.

7. A plasma transfer bag as claimed in claim 6 wherein the break is a V-shaped notch in the extension flap.

8. A plasma transfer bag as claimed in claim 6 or claim 7 wherein the break is an elliptical hole in the extension flap.

9. A plasma transfer bag as claimed in any one of claims 6 to 8 wherein the walls of the bag are reinforced by means of a weld on each side of the line of weakness.

10. A plasma transfer bag as claimed in claim 9 wherein each weld extends no more than 10% of the length of the line of weakness of the bag.

* * * * *